US009851054B2

(12) United States Patent
Vincent

(10) Patent No.: US 9,851,054 B2
(45) Date of Patent: Dec. 26, 2017

(54) UNIVERSAL LAMP SUPPORT

(71) Applicant: John Bryan Vincent, San Angelo, TX (US)

(72) Inventor: John Bryan Vincent, San Angelo, TX (US)

(73) Assignee: Principal LED, LLC, San Angelo, TX (US)

( * ) Notice: Subject to any disclaimer, the term of this patent is extended or adjusted under 35 U.S.C. 154(b) by 0 days.

(21) Appl. No.: 14/582,944

(22) Filed: Dec. 24, 2014

(65) Prior Publication Data

US 2015/0184807 A1 Jul. 2, 2015

Related U.S. Application Data

(60) Provisional application No. 61/920,791, filed on Dec. 26, 2013.

(51) Int. Cl.

| | |
|---|---|
| ***F21V 21/00*** | (2006.01) |
| ***F21K 99/00*** | (2016.01) |
| ***F21K 9/90*** | (2016.01) |
| ***F21K 9/27*** | (2016.01) |
| *F21V 19/00* | (2006.01) |
| *F21Y 103/10* | (2016.01) |
| *F21Y 115/10* | (2016.01) |

(52) U.S. Cl.

CPC ..... *F21K 9/17* (2013.01); *F21K 9/27* (2016.08); *F21K 9/90* (2013.01); *F21V 19/008* (2013.01); *F21Y 2103/10* (2016.08); *F21Y 2115/10* (2016.08); *Y10T 29/49169* (2015.01)

(58) Field of Classification Search

CPC ..... F21V 21/00; F21V 19/008; F21S 4/003; F21S 8/00; F21K 9/10; F21K 9/17; F21K 9/90; F21K 9/23; F21K 9/235; F21K 9/238; F21K 9/27; F21K 9/272; F21K 9/275; F21K 9/278; F21Y 2103/003; F21Y 2101/02; Y10T 29/49169

USPC ..... 362/217.01–217.17, 218–225, 249.02; 29/854

See application file for complete search history.

(56) References Cited

U.S. PATENT DOCUMENTS

| | | | | |
|---|---|---|---|---|
| 6,036,336 | A * | 3/2000 | Wu | 362/249.03 |
| 7,926,977 | B2 * | 4/2011 | Nall et al. | 362/249.02 |
| 8,083,373 | B2 | 12/2011 | Zimmerman | |
| 8,474,998 | B2 | 7/2013 | Wang | |
| 2007/0070631 | A1 * | 3/2007 | Huang | F21K 9/27 362/222 |
| 2009/0086478 | A1 * | 4/2009 | Sanroma et al. | 362/234 |
| 2010/0019689 | A1 * | 1/2010 | Shan | G09F 9/33 315/294 |
| 2010/0201239 | A1 * | 8/2010 | Mostoller et al. | 313/1 |

(Continued)

*Primary Examiner* — Jason Moon Han

(74) *Attorney, Agent, or Firm* — Jackson Walker L.L.P.; Randol Stout, Jr.

(57) ABSTRACT

An apparatus, manufacture and method of illumination support being a single monolithic substrate with light emitting diodes mounted on the external sides of the monolithic substrate. The necessary circuitry for the LEDs is embedded in one or more rigid or flexible electrical substrate that is affixed to one or more of the external sides of the monolithic substrate. The two terminal ends of the monolithic substrate are designed to fit into the lamp sockets of an existing or new light fixture without the use of end caps or end socket adapters, which provides structural support for the monolithic substrate.

15 Claims, 3 Drawing Sheets

(56) References Cited

U.S. PATENT DOCUMENTS

2012/0124874 A1* 5/2012 Breihof ..... 40/564
2014/0334142 A1* 11/2014 Levante et al. ..... 362/222

* cited by examiner

LEGEND
FIGURE 5 ONLY DEPICTS PRIOR ART

UNIVERSAL LAMP SUPPORT

CROSS-REFERENCE TO RELATED APPLICATIONS

This application claims priority from a provisional application Ser. No. 61/920,791, filed on Dec. 26, 2013; hereby incorporated by reference in its entirety.

STATEMENT REGARDING FEDERALLY SPONSORED RESEARCH DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A CD OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR JOINT INVENTOR

Not Applicable

BACKGROUND OF THE INVENTION

Many lighting applications use fragile fluorescent lamps or another type of lamp that may be replaced with Light Emitting Diodes ("LED") to increase energy efficiency and increase the service life of the lamp. Replacement of historical lamp types with LEDs is not a novel practice and has been occurring for the past decade or more. The novelty in this field of art is the invention of a structural support that facilitates the use of LEDs for illumination in existing light fixtures. This has been accomplished for several lighting applications. U.S. Pat. No. 6,036,336 claims an invention that facilitates the use of LEDs in the retrofitting of existing illuminated traffic signals. Other companies have invented a structure that facilitates the replacement of incandescent bulbs with LEDs while using the same unmodified light fixture. The invention is directed to a monolithic structural support for the replacement of fluorescent lamps, gas discharge lamps, and other lamp types that are supported at the two terminal ends of the lamp. This type of lighting is widely used in signs, including backlit signs and cabinet signs, and other applications where illumination is necessary.

The current invention eliminates the need for modification of the existing light fixture, the need for end caps to connect to the existing lamp sockets, and functions properly regardless of the orientation of the lamp sockets. The invention does this by an extruded monolithic substrate that has two terminal ends that are designed to fit directly into the existing lamp sockets without an end cap on the monolithic substrate or modification to the light fixture. The LEDs affixed to the exterior faces of the monolithic substrate provide illumination. The utility of the improvement over the prior art is that the invention will be easier and faster, to install when replacing existing lamps with new LED lamps. This is because many of the lighting applications to be retrofitted are elevated from the ground surface which makes it more difficult to hoist a cumbersome replacement structure that comes in multiple pieces. Additionally, if the lamp sockets are not oriented properly then the invention can be installed without regard to the orientation of the lamp socket and still provide maximum illumination on the sign face distinguishing the invention from the prior art. With the current invention the light weight and monolithic construction of the invention makes installation of the invention into the existing light fixture quicker and more efficient than previous inventions addressing this problem.

Field of the Invention

The disclosure relates to the support structure for a plurality of light emitting diodes to facilitate the replacement of existing fluorescent lamp types with light emitting diodes.

Description of the Related Art Including Information Disclosed Under 37 CFR 1.97 and 1.98

In U.S. Pat. No. 8,474,998 (998 Wang) the invention disclosed is a structural mounting system that facilitates the use of LEDs in the replacement of historical lamp types and specifically fluorescent lamps. This invention has an inner frame that makes a connection with the LED modules and two holding bases that are connected to the opposite ends of the inner frame of the light fixture or lighting cabinet. These holding bases are mechanically attached to the existing raceway structure of the existing light fixture. With these holding bases installed on the existing raceway the inner frame can be installed and the LED modules can serve as replacements for the previous fluorescent lamps. The drawback of this design is the need for installation of the holding bases in the existing light fixture which requires modification of the existing light fixture to accommodate the LED replacement.

In Published US Patent Application US 2012/0124874 A1 (Breihof) the invention disclosed is another structural mounting system that facilitates the replacement of previous lamp types with LEDs, specifically the replacement of fluorescent lamps. The invention disclosed includes an I-beam as the inner structural component which also has two opposite ends with specially designed end caps that are connected to each of the opposite ends of the I-beam. These end caps are designed so that the outward face of the end caps will fit into the existing lamp sockets of the fixture. The end caps in this application are designed to fit inside the existing lamp, sockets with a protruding rectangular piece that fits into the recessed lamp socket. The replacement LEDs or other lamp types are connected to the web of the I-Beam. If the lamp sockets are not all installed with the same orientation then invention may not direct the illumination in the proper direction to provide maximum illumination on the sign face. This would require the removal and reinstallation of the lamp sockets. This invention eliminates the need for modifications to the light fixture by using the existing lamp sockets as mechanical supports for the new LED lamps, but may not function properly unless all of the lamp sockets are properly oriented. The current invention also eliminates the need for an end cap or end socket adapters to install the invention into the existing lamp sockets.

BRIEF SUMMARY OF THE INVENTION

The invention is an extruded monolithic substrate that has terminal ends designed to fit within and connect with new or existing double recessed light sockets. The present invention is distinguished from the prior art because the monolithic substrate of the invention uses no end caps or end sockets to make the connection with the existing lamp socket. The entire monolithic substrate is a singular unitary piece of extruded material. Light Emitting Diodes ("LED") are affixed to the external faces of the monolithic substrate. The LEDs may be individually affixed to the external face of the monolithic substrate or the LEDs may be mounted on an electrical substrate that has an of the needed circuitry embedded within the electrical substrate and this electrical substrate may be affixed to the external face of the monolithic substrate. The monolithic substrate is designed and manufactured so that it fits into existing lamp sockets that are designed to accommodate fluorescent lamps or double recessed socket type. The purpose of the invention is to allow the replacement of previous fluorescent lamp types with LEDs to provide illumination at a reduced cost and extended service life.

The invention is manufactured starting with an extruded monolithic substrate that can be cut to any length desired, and bent or molded into a specific shape to fit a particular application. After the monolithic substrate is shaped then singular or plurality of LEDs are affixed to the external faces of the monolithic substrate. The LEDs can be arranged on an electrical substrate that has all of the needed circuitry embedded within the electrical substrate. This electrical substrate with LEDs is then affixed to the external faces of the monolithic substrate. The electrical substrate has electrical contact points that are connected to a power source to illuminate the LEDs. After affixing the electrical substrate with LEDs to the monolithic substrate a transparent weather protective sleeve may be installed over the monolithic substrate and LEDs to provide a weather proofing barrier. This transparent weather proofing sleeve may be made out of a heat shrinking material. After the transparent sleeve is attached a sealant is applied to the each of the terminal ends of the transparent sleeve to inhibit the movement of moisture within the transparent sleeve.

Many illuminated signs use fluorescent bulbs or a double contact gas discharge lamp to illuminate the interior of a light cabinet and thus illuminate the sign. It is desirable to replace the fluorescent or other lamp type in service with an LED. Other inventions in this field replace fluorescent lamps with LEDs using a support structure that uses end caps or end socket adapters to connect the support structure with the existing lamp socket. Lamp replacement with LEDs will provide a longer service life and reduced operating costs: Since lighted cabinet signs are ubiquitous it is desired to replace the lamp type but to use the existing light fixture and avoid the cost of replacing the light fixture. The invention provides for a method of retrofitting existing lighted signs that use fluorescent lamps with recessed T-12 sockets. The steps in the method are: the monolithic substrate is sized and shaped to the desired dimensions, assembled with LEDs and needed circuitry to the external faces of the monolithic substrate, and installed into and connected to the existing lamp sockets. The LEDs are independently connected to the power source and the connection between the power source and the existing lamp sockets is disconnected. Once the wiring is complete the invention will provide replacement illumination.

BRIEF DESCRIPTION OF THE SEVERAL VIEWS OF THE DRAWING(S)

DETAILED DESCRIPTION OF THE INVENTION

Embodiments of the invention are directed to a extruded monolithic substrate for support of LEDs 1 (FIG. 1) to facilitate the replacement of florescent lamps 14 (FIG. 7), or other type of double contact lamps, with light emitting diodes (LED) to illuminate a light cabinet or other lighting applications. The extruded monolithic substrate is an elongate form that may have a hollow or solid cross section core. The preferred embodiment of the invention has a monolithic substrate with a square cross section with a hollow core. The monolithic substrate may be made of any material and in any cross sectional shape as may be extruded. The ends of the monolithic substrate may be machined to fit into the shape of the existing lamp sockets if the shape of the cross section of the monolithic substrate does not match the existing lamp socket. The monolithic substrate of the invention is a unitary piece and functions without the use of end caps or end socket adapters needed to connect the monolithic substrate with the existing lamp socket.

Figure 1:
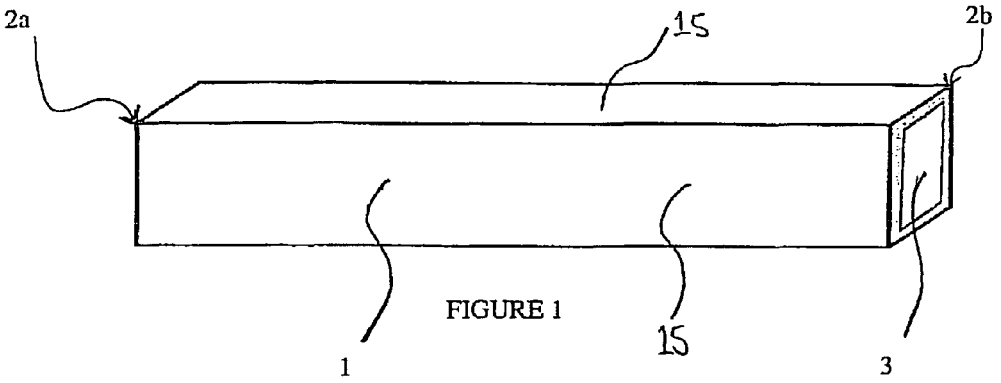
FIG. 1 is a perspective view of the elongate support element.
Figure 2:
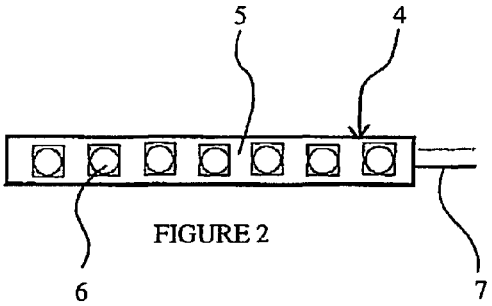
FIG. 2 is a top view of the LED String (Only Prior Art Depicted)
Figure 3:
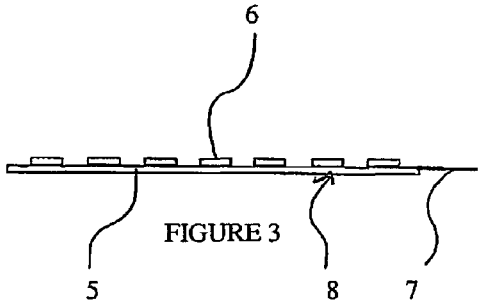
FIG. 3 is a side view of the LED String (Only Prior Art Depicted)
Figure 7:
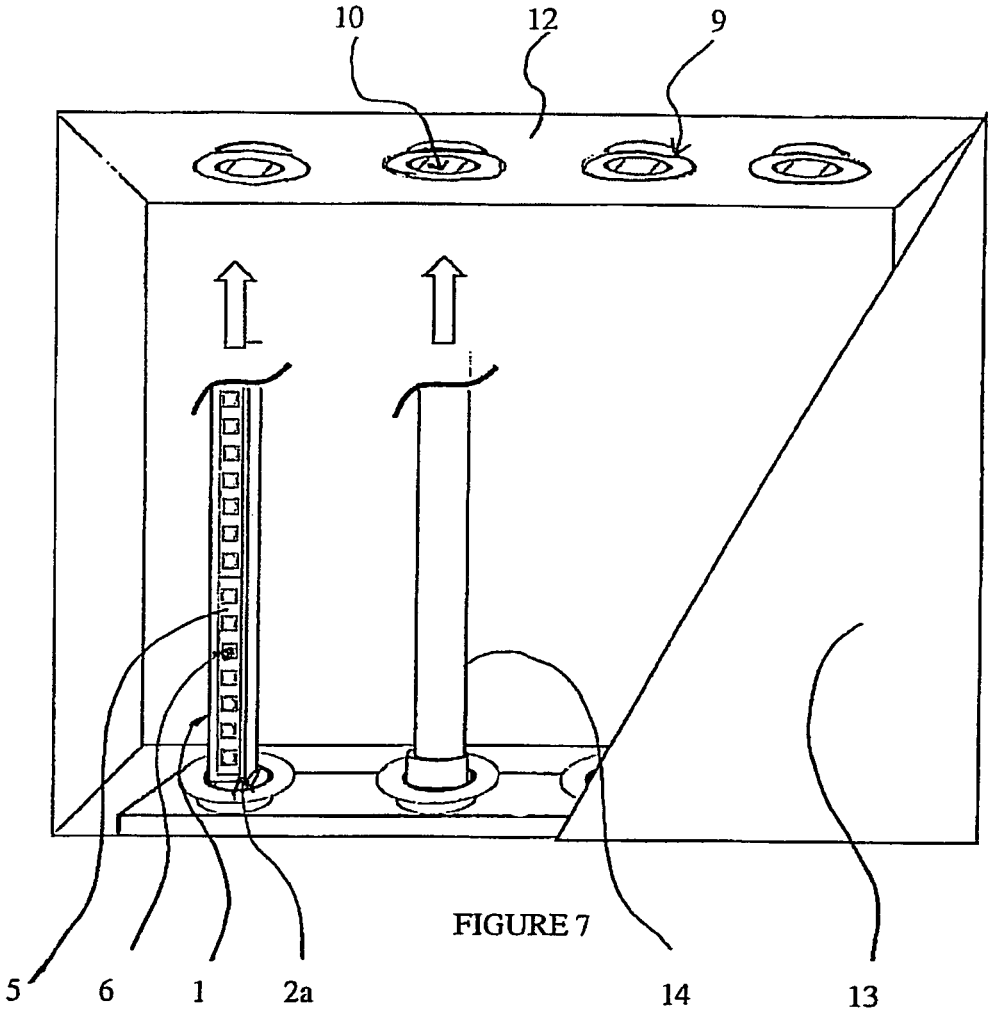
FIG. 7 depicts a light cabinet with the invention installed in the opposing lamp sockets.

Installation of the invention is easy and requires no additional support brackets or end cap adapters because the terminal ends 2*a*, 2*b* (FIG. 1) of the monolithic substrate 1 (FIG. 1) are designed to fit directly into the existing light fixture 12 (FIG. 7) lamp sockets 9 (FIG. 7) and use these as the structural supports. When the invention is installed in two opposing lamp sockets then it is secured in its service position 12 (FIG. 7). The existing lamp sockets are used as structural supports but are eliminated as live circuits and instead the light emitting diodes are wired directly to the power source. The monolithic substrate can accommodate various types of light emitting diodes 6 (FIGS. 2 and 3). The monolithic substrate may be straight, bent, or curved to accommodate different light cabinet shapes as needed.

Figure 4:
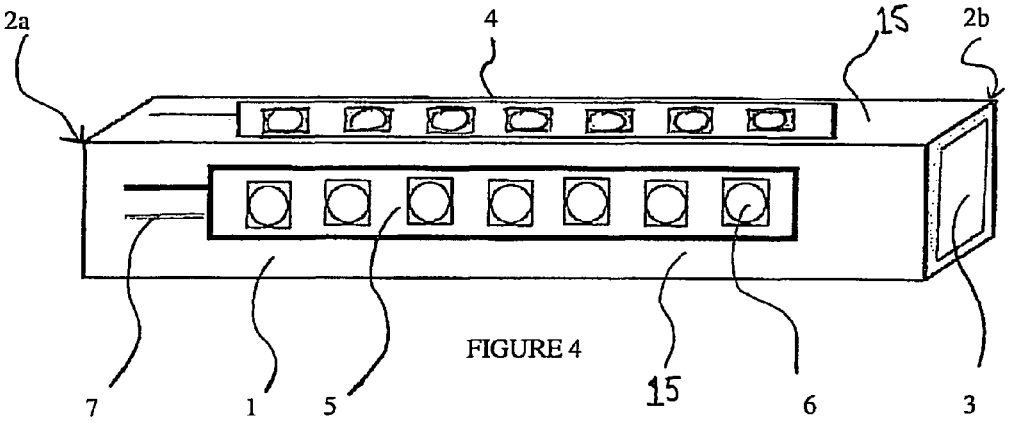
FIG. 4 is a perspective of the elongate support member with LED String attached on two exterior faces of the support element.

The configurations of LEDs that work with the monolithic substrate include but are not limited to the following examples. The LED can be mounted onto a flexible or rigid substrate defined as the electrical substrate 5 (FIGS. 2 and 3) and the electrical substrate may contain all the needed circuitry to deliver the appropriate power to the LED, as well as any other electronic components required to control the LED. When mounted on to an electrical substrate with all the needed circuitry contained within the electrical substrate; the electrical substrate, inner circuitry, and LEDs are referred to, and defined as, a "LED String" 4 (FIGS. 2 and 4). A String may contain one or more LEDs. The LEDs can also be mounted onto multiple electrical substrates. The multiple electrical substrates can contain the circuitry required for powering the LED or controlling the LED, facilitate the connection between the LED String and the monolithic substrate, and provide a weather and moisture barrier to protect the LED and circuitry. The electrical substrate may also be mounted on an adhesive substrate 8 (FIG. 3) that facilitates the connection of the LED String to the monolithic substrate. The LED String may also be encased in a transparent substrate to provide a weather and moisture barrier to extend the service life of the LED. The LED String may also be mounted onto a housing piece that facilitates the connection between the LED String and the monolithic substrate. The LED String may also have notches or holes in the Sting that facilitates the connection to the monolithic substrate.

The monolithic substrate is comprised of two terminal ends 2*a*, 2*b* (FIGS. 1, 4, and 6) and an elongate solid or hollow body portion 1 (FIG. 1, 4, 6) between the two terminal ends. The elongate body portion has multiple exterior sides 15 (FIGS. 1, 4 and 6) upon which a LED String 4 (FIG. 2) can be affixed or connected. An external side of the support element can be either a flat external side of the monolithic substrate or be the external side of the elongate body of the monolithic substrate in the case of a monolithic substrate with a circular cross section.

Figure 5:
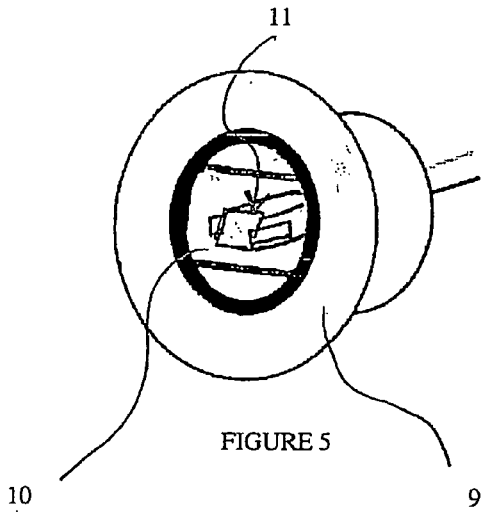
FIG. 5 is perspective view of a T-12 lamp socket (Only Prior Art Depicted)

The invention is made by determining the appropriate dimensions of the needed elongate body length of the invention and size of the terminal ends of the monolithic substrate so that they may fit, without modification, directly into the existing light fixture 12 (FIG. 7) lamp sockets 9 (FIGS. 5 and 7). Once the light fixture lamp socket dimensions have been determined then the terminal ends of the monolithic substrate can be designed to fit into the light fixture lamp socket. The light fixture lamp socket dimensions may determine the height and depth of the terminal ends of the monolithic substrate but the elongate body of the monolithic substrate may be of larger or smaller dimensions as is structurally required. Once the monolithic substrate is sized then one or more LED Strings 4 (FIGS. 2 and 4) are affixed to the external sides 15 (FIGS. 1, 4 and 6) of the monolithic substrate. After affixing or connecting the LED String or Strings to the external side or sides, of the monolithic substrate elongate body then a transparent plastic sleeve may be installed over the entire length of the monolithic substrate and LED Strings to provide a standalone or additional weather and moisture barrier. This transparent sleeve moisture barrier may be made of a heat shrinkable material. Furthermore, silicone, hot melt copolymer, epoxy, or other sealant may be injected inside the ends of the transparent sleeve to provide additional moisture resistance.

Figure 6:
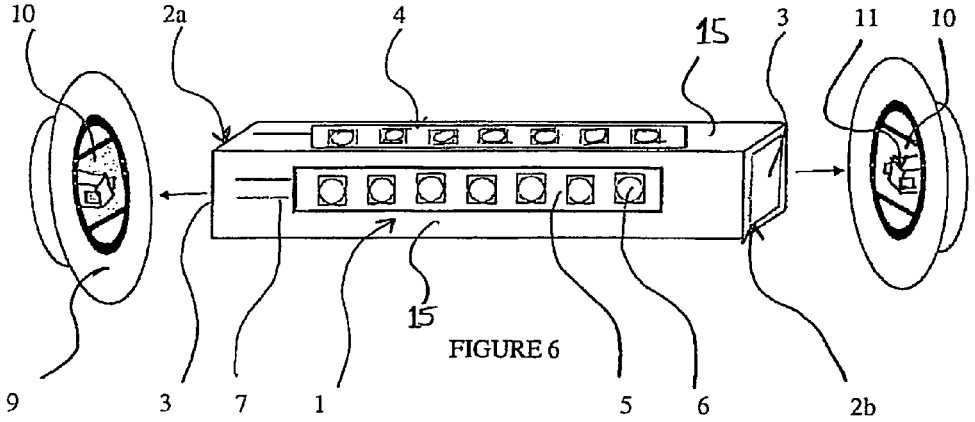
FIG. 6 depicts how the invention is installed between two opposing lamp sockets.

The preferred embodiment of the invention is an elongate monolithic extrusion 1 (FIGS. 1, 4, 6 and 7) that is designed with terminal end 2*a*, 2*b* (FIGS. 1, 4 and 6) dimensions that fit securely into widely used existing T-12 sockets 9 (FIGS. 5, 6 and 7) of a light cabinet 12 (FIG. 7). The monolithic substrate has an elongate body with a square cross section and a hollow core 3 (FIGS. 1, 3 and 6). The elongate body of the monolithic substrate has the same cross section dimensions as those of the terminal ends, being a square cross section. The T-12 lamp sockets have a recessed rectangular hole 10 (FIGS. 5 and 6) that has a protruding contact piece 11 (FIGS. 5 and 6) within the recessed hole of the lamp socket 9 (FIGS. 5, 6 and 7). The monolithic substrate 1 (FIG. 6) is installed by pushing the terminal end 2*a*, 2*b* (FIG. 6) into the recessed opening 10 (FIG. 6) of the lamp socket 9 (FIG. 6) and the protruding contact 11 (FIGS. 5 and 6) fits snuggly within the hollow terminal end opening 3 (FIG. 6) of the monolithic substrate.

The length of the invention is determined by the length of the florescent lamps 14 (FIG. 7) that are being replaced. Once the monolithic substrate has been extruded and cut to size for length then a LED String or LED Strings, are affixed to the external side or sides 15 (FIGS. 1, 4 and 6) of the monolithic substrate as needed. The LED String 4 (FIG. 2) contains one or more LEDs 6 (FIGS. 2 and 3) mounted on a flexible electrical substrate 5 (FIGS. 2 and 3) that contains and encloses all the needed circuitry within the flexible electrical substrate, the flexible electrical substrate has the LED on one external face of the flexible electrical substrate and an adhesive tape 8 (FIG. 3) on the opposite external face of the flexible electrical substrate. This adhesive tape facilitates the connection between the LED String and the monolithic substrate. After connecting the LED String to the monolithic substrate as needed a transparent heat shrinking sleeve is pulled over the elongate body of the monolithic substrate covering the entire body of the monolithic substrate and LED String. A commercial sealant is then added to one or both ends of the transparent sleeve between the sleeve and the monolithic substrate providing a moisture resistant barrier between the transparent sleeve and the monolithic substrate, particular care should be taken in applying the sealant when wiring 7 (FIGS. 2, 3 and 4) from LED String to the power source exit from within the transparent sleeve. If the LED String 4 (FIGS. 2 and 4) external wiring 7 (FIGS. 2, 3 and 4) to the power source does not enter through the end of the transparent sleeve but rather enters the transparent sleeve between the two ends of the transparent sleeve then sealant should be applied where the external wiring enters the transparent sleeve. After the sealant has been applied between the transparent sleeve and the monolithic substrate then heat is applied to the transparent sleeve so that the sleeve provides a tight fit around the LED String and the monolithic substrate.

The invention claimed is:

1. An apparatus, comprising:

a lamp support comprising an elongated extrusion including four sides enclosing a hollow core extending from a first end of the elongated extrusion to a second end of the elongated extrusion, wherein each end of the elongated extrusion is configured to fit securely within a recess of a recessed double contact socket, wherein a protruding contact structure, which protrudes from the recess, is received within the hollow core of the elongated extrusion; and one or more light emitting diode (LED) strings, affixed to one or more of the four sides of the elongated extrusion, wherein each LED string includes:

one or more LEDs; and wiring suitable for connecting the one or more LEDs to a power source not connected to the protruding contact, thereby enabling powering of the LED string independently of the protruding contact.

2. The apparatus of claim 1, wherein a cross-section of the elongated extrusion is rectangular.

3. The apparatus of claim 2, wherein the cross-section of the elongated extrusion is square.

4. The apparatus of claim 1, wherein the elongated extrusion comprises a rigid plastic elongated extrusion.

5. The apparatus of claim 1, wherein the elongated extrusion comprises a metal elongated extrusion.

6. The apparatus of claim 1, wherein each LED light string includes a substrate, wherein the substrate includes circuitry and components configured to deliver power appropriate for the one or more LEDs.

7. The apparatus of claim 6, wherein the substrate comprises a flexible substrate.

8. The apparatus of claim 7, wherein the one or more LEDs are affixed to a first external surface of the flexible substrate and wherein adhesive tape is affixed to a second external surface of the flexible substrate.

9. The apparatus of claim 8, further comprising:

a transparent sleeve, heat shrunk to encapsulate the lamp support and the one or more LED strings.

10. The apparatus of claim 9, further comprising a sealant applied at one or both ends of the transparent sleeve.

11. The apparatus of claim 6, wherein the substrate comprises a rigid substrate.

12. The apparatus of claim 6, further comprising:

an adhesive substrate to facilitate connection between the one or more LED light strings and the elongated extrusion.

13. The apparatus of claim 1, wherein each end of the elongated extrusion is configured to fit securely within a recess of a T-12 recessed double contact socket.

14. The apparatus of claim 1, wherein one or more of the LED light strings are affixed to two or more of the four sides of the elongated extrusion.

15. The apparatus of claim 1, wherein one or more of the LED light strings are affixed to three or more sides of the elongated extrusion.

* * * * *